US011008122B2

(12) United States Patent
Merk et al.

(10) Patent No.: US 11,008,122 B2
(45) Date of Patent: May 18, 2021

(54) THERMOFORM PACKAGING MACHINE AND METHOD OF OPERATING A THERMOFORM PACKAGING MACHINE

(71) Applicant: Multivac Sepp Haggenmuller SE & Co. KG, Wolfertschwenden (DE)

(72) Inventors: Stefan Merk, Wolfertschwenden/Niederdorf (DE); Martin Jochem, Immenstadt im Allgäu (DE); Verena Schüller, Pürgen (DE); Daniel Mair, Immenstadt (DE); Thomas Simon, Kammeltal (DE); Norbert Wörz, Erkheim (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 163 days.

(21) Appl. No.: 16/168,928

(22) Filed: Oct. 24, 2018

(65) Prior Publication Data

US 2019/0127101 A1 May 2, 2019

(30) Foreign Application Priority Data

Oct. 26, 2017 (DE) ..... 10 2017 125 077.8

(51) Int. Cl.
*B65B 9/04* (2006.01)
*B65B 59/02* (2006.01)
(Continued)

(52) U.S. Cl.
CPC ..... *B65B 9/04* (2013.01); *B65B 31/021* (2013.01); *B65B 41/18* (2013.01); *B65B 57/04* (2013.01);
(Continued)

(58) Field of Classification Search
CPC ..... B65B 7/162; B65B 7/164; B65B 9/04; B65B 11/52; B65B 31/021; B65B 41/12;
(Continued)

(56) References Cited

U.S. PATENT DOCUMENTS 4,018,028 A * 4/1977 Donnet ..... B65B 9/04 53/51
4,349,997 A 9/1982 Hayasaka et al.
(Continued)

FOREIGN PATENT DOCUMENTS

CA 2498654 A1 * 4/2004 ..... B65H 23/1882
CN 1681728 A1 10/2005
(Continued)

OTHER PUBLICATIONS

Chinese First Office Action dated Jul. 1, 2020 (with English Translation), Application No. 201811255368.7, Applicant Multivac Sepp Haggenmueller SE & Co KG, 22 Pages.

*Primary Examiner* — Stephen F. Gerrity
(74) *Attorney, Agent, or Firm* — Brooks Kushman P.C.

(57) ABSTRACT

A thermoform packaging machine comprising, as work stations, a forming station for thermoforming troughs in a packaging film, at least one sealing station for sealing the troughs with a cover film, and a cutting station as well as a feeding device for causing a feed of the packaging film. A method for using such a thermoform packaging machine wherein a controller determines for two or more work stations, prior to a process step, which required feed length each of these work stations has, the required feed length indicating the distance by which the packaging film will have to be conveyed for the next process step of the respective work station, before a feed length specification is ascertained from the required feed lengths determined and the feeding device is controlled accordingly.

18 Claims, 8 Drawing Sheets

(51) Int. Cl.

| | |
|---|---|
| ***B65B 57/04*** | (2006.01) |
| ***B65B 41/18*** | (2006.01) |
| ***B65B 7/16*** | (2006.01) |
| ***B65B 47/00*** | (2006.01) |
| ***B65B 31/02*** | (2006.01) |
| ***B65B 59/00*** | (2006.01) |

(52) U.S. Cl.
CPC ..... *B65B 59/003* (2019.05); *B65B 59/005* (2013.01); *B65B 59/02* (2013.01); *B65B 7/164* (2013.01); *B65B 47/00* (2013.01)

(58) Field of Classification Search
CPC ..... B65B 41/18; B65B 47/00; B65B 57/02; B65B 57/04; B65B 57/12; B65B 59/003; B65B 59/02
USPC ..... 53/453, 51, 64, 559
See application file for complete search history.

(56) References Cited

U.S. PATENT DOCUMENTS

| | | | | |
|---|---|---|---|---|
| 4,549,386 | A | 10/1985 | Wilson | |
| 4,951,444 | A * | 8/1990 | Epstein et al. | B65B 9/04 53/433 |
| 9,540,128 | B2 * | 1/2017 | Monti | B65B 57/04 |
| 2014/0150377 | A1 | 6/2014 | Ehrmann et al. | |
| 2014/0305073 | A1 | 10/2014 | Monti | |
| 2015/0096263 | A1 * | 4/2015 | Ehrmann | B65B 9/04 53/411 |
| 2016/0068292 | A1 | 3/2016 | Fries | |
| 2016/0159510 | A1 * | 6/2016 | Lau et al. | B65B 65/003 53/453 |

FOREIGN PATENT DOCUMENTS

| | | | | |
|---|---|---|---|---|
| CN | 105189293 | A | 12/2015 | |
| DE | 2437127 | A1 * | 2/1976 | B65B 9/04 |
| DE | 3816262 | A1 | 11/1988 | |
| DE | 4216209 | C2 | 10/1996 | |
| DE | 69215059 | T2 | 3/1997 | |
| DE | 10152891 | A1 | 5/2003 | |
| DE | 60006480 | T2 | 9/2004 | |
| DE | 102008024461 | A1 * | 12/2009 | B65B 57/00 |
| DE | 102015211622 | A1 | 12/2016 | |
| EP | 0569933 | A1 * | 11/1993 | B65B 57/00 |
| EP | 640526 | A1 | 3/1995 | |
| EP | 2740672 | A1 * | 6/2014 | B65B 57/04 |
| EP | 2860119 | A1 | 4/2015 | |

* cited by examiner

THERMOFORM PACKAGING MACHINE AND METHOD OF OPERATING A THERMOFORM PACKAGING MACHINE

CROSS-REFERENCE TO RELATED APPLICATIONS

This application claims priority to German Patent Application No. 10 2017 125 077.8 filed on Oct. 26, 2017 to Stefan Merk, Martin Jochem, Verena Schüller, Daniel Mair, Thomas Simon and Norbert Wörz, currently pending, the entire disclosure of which is incorporated herein by reference.

FIELD OF THE INVENTION

The present invention relates to a method of operating a thermoform packaging machine as well as to such a thermoform packaging machine itself.

BACKGROUND OF THE INVENTION

A thermoform packaging machine of the generic kind is disclosed e.g. by DE 10 2015 211 622 A1. Such packaging machines are characterized by a forming station for thermoforming troughs in a packaging film and comprise normally a sealing station for sealing the thermoformed troughs with a cover film as well as a cutting station for separating the produced packages from one another. In addition, these machines comprise a feed unit for causing a feed of the packaging film.

In most cases, such a thermoform packaging machine is operated intermittently or cyclically. In each work cycle, the packaging film is advanced using the feed unit by a constant, fixedly predetermined feed length. In this case, the feed length is also referred to as "unwinding length". It indicates which length each packaging format produced in a single work cycle has in the production direction of the thermoform packaging machine.

In order to be able to actually keep the feed length exactly constant from one work cycle to the next, enormous efforts are sometimes made. DE 42 16 209 C2, for example, describes a thermoform packaging machine in which the packaging film is provided with so-called print marks at regular intervals. After these print marks have been detected using a suitable print mark sensor, the position of various work stations in the packaging machine according to DE 42 16 209 C2 can be changed in the longitudinal direction of the packaging machine, so that the work stations will be set to the ideal position relative to the print marks. The feed length of the packaging film can thus remain constant in each work cycle. In the machine according to EP 2 860 119, however, the length of a film feed with respect to an exact target position is controlled in the sealing station alone.

SUMMARY OF THE INVENTION

It is the object of the present invention to improve a thermoform packaging machine and a method of operating such a thermoform packaging machine with respect to their flexibility of use and versatility as well as efficiency.

The method according to the present invention relates to the operation of a thermoform packaging machine comprising a controller (e.g. a programmable logic controller [PLC] or a microprocessor) and, as work stations, a forming station for thermoforming troughs in a packaging film—normally a plastic packaging film—at least one sealing station for sealing the troughs with a cover film, and a cutting station, the thermoform packaging machine comprising in addition a feeding device for causing a feed of the packaging film. The method of operating this thermoform packaging machine comprises the following steps: the controller determines for two or more work stations, prior to a process step, which required feed length (viz. feed length requirement) each of these work stations has, the required feed length indicating the distance by which the packaging film will have to be conveyed for the next process step of the respective work stations; the plurality of required feed lengths determined are used for ascertaining therefrom a feed length specification; and the feeding device may be controlled to convey the packaging film by a feed length corresponding to the feed length specification.

It follows that the present invention departs from the hitherto preferred concept of keeping the feed length as constant as possible before each process step. A process step means here the execution of a primary function of the respective work station, i.e. in a forming station the thermoforming of troughs in the packaging film, in a sealing station the sealing of the troughs with a cover film or in a cutting station the making of a cut in the packaging film. The present invention now takes into account that the required feed length may be different for different work stations. Therefore, the required feed lengths for two or more work stations, optionally even of all the work stations, are compiled first, before a single feed length specification may be ascertained from the plurality of required feed lengths, which may possibly differ from one another. The feeding device then may be controlled, preferably using the controller of the thermoform packaging machine, to convey the packaging film by a feed length corresponding to the feed length specification.

A great advantage of the present invention resulting from these measures may be that not only will the respective work stations be able to act on the packaging film at the respective optimum locations, but the thermoform packaging machine will, moreover, even be able to produce and process different packaging formats without a change of packaging material and even in an irregular sequence.

Preferably, the required feed length of the two or more work stations may be determined before each individual feed of the packaging film, and a feed length specification may be ascertained therefrom. Analogously, it may be imaginable that the thermoform packaging machine may be operated cyclically, in particular in regular work cycles, and that the required feed lengths of the two or more work stations are determined in each individual work cycle and a feed length specification may be ascertained therefrom. In this way, the advantages of the present invention become effective throughout the operation of the thermoform packaging machine.

According to a variant embodiment of the present invention, the feeding device may be controlled to convey the packaging film by a feed length that corresponds to the smallest required feed length determined. On the one hand, this has the advantage that, using this measure, also the duration for the next feed can be kept particularly short and that the overall performance of the thermoform packaging machine will be increased in this way. On the other hand, this measure makes it possible that, after the process step of the work station having the smallest required feed length has been executed, the feed of the packaging film can be matched to the required feed length of the work stations having a larger required feed length. In this way, each of the work stations involved will be able to execute its own process step. This variant of the present invention will be particularly advantageous in the event that the positions of the individual work stations along the thermoform packaging machine cannot be changed.

A variant of the method according to which the position of at least one of the work stations can be displaced in a production direction of the thermoform packaging machine and will be displaced when the process may be executed is, however, imaginable as well. In this way, the degree of freedom in the selection of the feed length specification has added thereto, as a second degree of freedom, a change of position of the at least one work station in the production direction of the thermoform packaging machine. It may also be possible to change the position of a plurality of or even all of the work stations in the production direction. This second degree of freedom increases the flexibility of use of the thermoform packaging machine still further. In addition, this variant of the method provides the possibility of further increasing the performance of the thermoform packaging machine by matching the feed length specification and the positioning of the work stations to one another with the aim of achieving the highest possible cycle output of the packaging machine and by optimizing them by allowing the highest possible number of work stations to execute their process step in each cycle.

When the positions of not only one, but even of a plurality of the work stations of the thermoform packaging machine are displaceable in the production direction over a predetermined area of displacement, it may be particularly advantageous to determine, taking into account the respective area of displacement, a feed length specification range for each of these work stations. The minimum of this feed length specification range may be the feed length that would be necessary for the respective work station, if the work station were to move to its furthest upstream position prior to the next process step. The maximum of the feed length specification range may be the feed length that would be necessary, if the respective work station were moved to its furthest downstream position prior to its next process step. Hence, the difference between the maximum and the minimum of the feed length specification range corresponds to the length of the area of displacement of the respective work station.

In the case of this variant of the method, it will be advantageous when the feed length specification may be chosen from an overlapping range in which the feed length specification ranges of the work stations, which have positions that are displaceable in the production direction, overlap. For example, the feed length specification could be selected from the middle third of the overlapping range or even exactly at the center of the overlapping range.

The present invention also relates to a thermoform packaging machine comprising as work stations at least one forming station for thermoforming troughs in a packaging film, at least one sealing station for sealing these troughs with a cover film, and at least one cutting station, the thermoform packaging machine comprising in addition a feeding device for causing a feed of the packaging film as well as a controller (e.g. a programmable logic controller [PLC] or a microprocessor). The invention may be characterized in that the feeding device may be configured for generating a feed length which may be variable for any process step of the thermoform packaging machine, that the controller comprises a determining section, which may be configured to determine, for two or more work stations, a required feed length of the respective work station, that the controller comprises an evaluation section, which may be configured to determine a feed length specification from the required feed lengths of the two or more work stations, and that the controller may be configured to control the feeding device to move the packaging film by a feed length corresponding to the feed length specification.

The determining section of the controller may here either calculate by itself which required feed lengths the two or more work stations have, or the respective required feed lengths may be transmitted thereto by the work stations. As has already been stated in connection with the method according to the present invention, the invention departs from the concept of fixed feed lengths. The variable feed length allows an optimized operation of the thermoform packaging machine, in particular an alternating or even random processing of formats of different sizes.

The feeding device may be configured for generating a stepwise variable or even a continuously variable feed length. While a stepwise variable feed length minimizes the computing effort required for the controller, a continuously variable feed length allows an even more versatile operation of the thermoforming packaging machine.

It will be advantageous when the feeding device comprises a clamp chain with a controllable servomotor. While the clamp chain reliably grips the packaging film, the servomotor can be controlled with different feed length specifications.

The evaluation section of the controller may be preferably configured for ascertaining the smallest required feed length. In this case, the controller may be configured for controlling the feeding device to move the packaging film by a feed length that corresponds to the smallest required feed length. As has already been stated hereinbefore, this variant will be particularly advantageous, when the positions of the individual work stations along the thermoform packaging machine cannot be changed.

According to another variant of the invention, the position of at least one of the work stations, preferably of a plurality of or even all of the work stations, may be displaceable in the production direction. This allows the positions of the work stations to be changed such that, in combination with the variable feed length specification, the performance of the thermoform packaging machine will be maximized.

When it may be even possible to displace the positions of a plurality of the work stations in the production direction over a respective predetermined area of displacement, it will be particularly advantageous when a feed length specification range may be determinable for each of these work stations, taking into account their respective area of displacement. As has already been stated with respect to the method, it will also be particularly advantageous, when the evaluation section may be configured for ascertaining an overlapping range, in which the feed length specification ranges of the work stations, which have positions that are displaceable in the production direction, overlap, and for selecting the feed length specification from the overlapping range.

Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
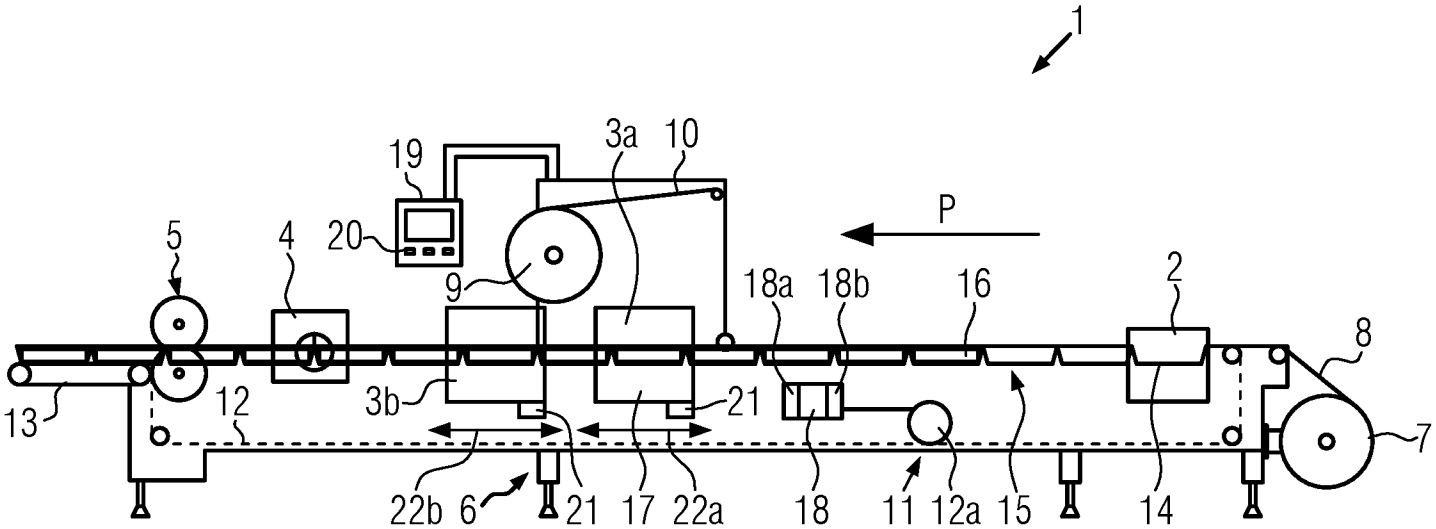
FIG. 1 is a schematic side view of one embodiment of a thermoform packaging machine in accordance with the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic side view of a thermoform packaging machine 1. This thermoform packaging machine 1 comprises a forming station 2, a first sealing station 3*a*, a second sealing station 3*b*, a cross cutting station 4 and a longitudinal cutting station 5, which are arranged, in this sequence, on a machine frame 6 in a production direction P. On the input side, the machine frame 6 has provided thereon a supply roll 7, from which a packaging film/foil 8 is unwound. In the area of the sealing stations 3*a*, 3*b*, a material storage unit 9 is provided, from which a cover film/foil 10 is unwound. On the output side, the packaging machine has provided thereon a discharge device 13 in the form of a conveyor belt, using which, finished, singular and separated packages are transported away. The packaging machine 1 further comprises a feeding device 11, which grips the film 8 and advances it intermittently in the production direction P per main work cycle. The feeding device 11 may e.g. comprise clamp chains 12 acting on the packaging film 8 on both sides thereof.

The forming station 2 is configured as thermoforming station, in which troughs 14 are formed into the packaging film 8, which will normally be a plastic film, by thermoforming. The forming station 2 may here be configured such that, in the production direction P and/or in the direction perpendicular to the production direction P, a plurality of troughs is formed side by side. Downstream of the forming station 2, when seen in the production direction P, an infeed line 15 is provided, along which the troughs 14 formed in the packaging film 8 are filled with a product 16.

Each sealing station 3*a*, 3*b* is provided with a closable chamber 17, in which the atmosphere in the troughs 14 can be substituted, prior to sealing, by an exchange gas or a gas mixture, e.g. by gas flushing.

The cross cutting unit or cutting station 4 is configured as a punch, which cuts the packaging film 8 and the cover film 10 in a direction transversely to the production direction P between neighboring troughs 14. In so doing, the cross cutting unit 4 works such that the packaging film 8 is not cut over the entire width, but remains uncut at least in an edge area thereof. This allows controlled further conveyance by the feeding device 11.

In the embodiment shown, the longitudinal cutting unit or second cutting station 5 is configured as a blade arrangement using which the packaging film 8 and the cover film 10 are cut between neighboring troughs 14 and at the lateral edge of the packaging film 8, so that, down-stream of the longitudinal cutting unit 5, singulated packages are obtained.

The packaging machine 1 is additionally provided with a controller 18. The controller 18 has the function of controlling and monitoring the processes taking place in the packaging machine 1. A display device 19 with operating controls 20 serves to visualize the sequences of process steps in the packaging machine 1 for an operator and to influence them by the operator.

In the following, the general mode of operation of the packaging machine 1 will be described briefly.

The packaging film 8 is unwound from the supply roll 7 and conveyed into the forming station 2 by the feeding device 11. In the forming station 2, troughs 14 are formed in the packaging film 8 by thermoforming. The troughs 14, together with the area of the packaging film 8 surrounding them, are advanced to the infeed line 15. During the feed motion or when the feed is standing still, a product 16 is placed into the troughs 14.

Subsequently, the filled troughs 14 are advanced to the sealing station 3*a*, 3*b* by the feeding device 11. In the sealing station 3*a*, 3*b*, the troughs 14 may optionally be evacuated and/or flushed with a protective gas before the cover film 10 is sealed onto the troughs 14 so as to hermetically seal the troughs 14. The cross and longitudinal cutting units 4, 5 ensure that the troughs 14 will be separated from one another, the troughs 14 being finally transported away on the discharge device 13. A servomotor 12*a*, which is controllable by the controller 18, is provided as a drive for the clamp chain 12.

In FIG. 1, two different embodiments of the thermoform packaging machine 1 are indicated already. In the first embodiment, the position of the work stations 2, 3*a*, 3*b*, 4, and 5 cannot be changed in the production direction P of the thermoform packaging machine 1. In a second embodiment, however, the positions of certain work stations, here, concretely, the two sealing stations 3*a*, 3*b*, can be changed independently of one another in the production direction P. This means that the respective work stations 3*a*, 3*b* can be displaced in or contrary to the production direction P. For this purpose, each of the two sealing stations 3*a*, 3*b* has a linear drive 21 associated therewith, which is controllable by the controller 18 and which is configured to change the position of the sealing station 3*a*, 3*b* in question over a respective area of displacement 22*a*, 22*b*.

Figure 2A:
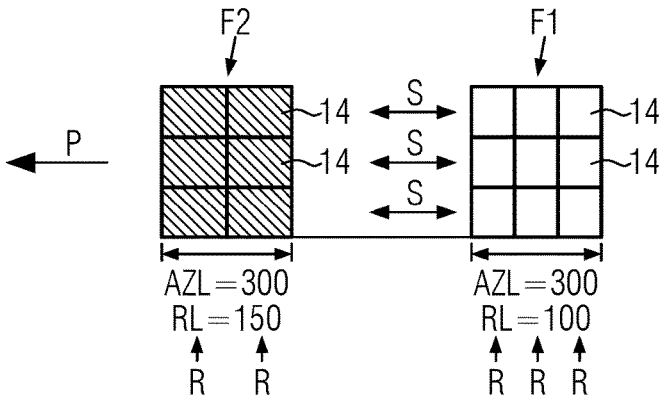
FIG. 2A is a schematic top view of two different formats produced on one embodiment of the thermoform packaging machine of FIG. 1 in accordance with the present disclosure.

FIG. 2A shows schematically a top view of a first format F1 and of a second format F2, which can be produced by the thermoform packaging machine 1. For example, it would be imaginable that the thermoform packaging machine comprises two forming stations 2 in succession, when seen in the production direction P, one of these forming stations producing an array of packaging troughs 14 in the format F1, whereas the other one is capable of producing an array of troughs 14 in the format F2. A format is here a respective group of troughs 14, which are produced in common in a process step in the packaging film 8. Alternatively, also a single forming station 2 may produce the two different formats.

The two formats F1, F2, which are shown exemplarily in FIG. 2A, are each multi-row and multi-track formats, i.e. they each comprise a plurality of juxtaposed tracks S of troughs 14 parallel to the production direction P as well as a plurality of successive rows R of troughs 14 transversely to the production direction P. The first format F1 comprises three tracks S and three rows R, each individual row R having a so-called "row length" RL of 100 mm in the production direction P. In total, an overall length (the so-called "unwinding length", AZL) of the format F1 of 300 mm is thus obtained in the production direction P.

The second format F2, however, comprises three tracks S as well, but only two rows R. Each row R has here a "row length" RL of 150 mm in the production direction P. It follows that, when seen in the production direction P, the second format F2 has, in total, the same unwinding length AZL of 300 mm as the first format F1.

Figure 2B:
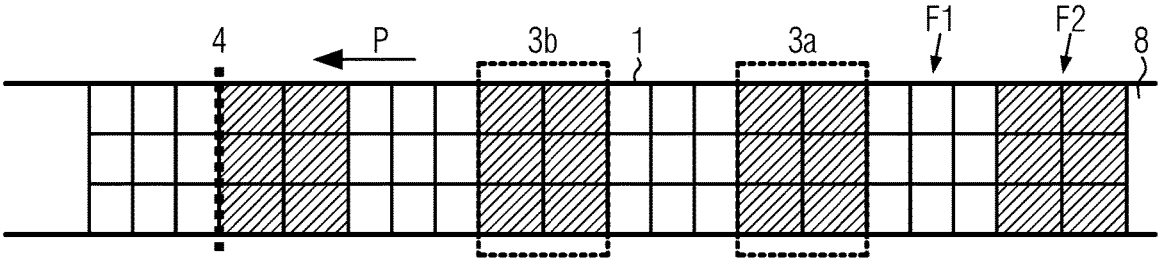
FIG. 2B is a schematic top view of a state of operation of the thermoform packaging machine according to FIG. 1.

FIG. 2B shows a schematic top view of a thermoform packaging machine 1 at a certain moment in time in the operating sequence. It can be seen that respective first formats F1 alternate with respective second formats F2 in the production direction P. The first sealing station 3*a* is configured to seal the troughs 14 of a first format F1 with the cover film 10. This means that a sealing tool of the first sealing station 3*a*, e.g. a so-called sealing frame, has a contour according to the division of the troughs 14 in the first format F1 and is thus able to provide each trough 14 of the first format F1 with a circumferentially extending sealing seam. The second sealing station 3*b*, however, is configured to seal the troughs of the second format F2. This means that a sealing tool of the second sealing station 3*b*, e.g. a sealing frame of the second sealing station 3*b*, has a contour according to the division of the troughs in the second format F2. This enables the second sealing station 3*b* to provide each trough 14 in the second format F2 with a circumferentially extending sealing seam. The cross cutting unit 4 produces a cut transversely to the production direction P through the packaging film 8 at the point shown in FIG. 2B. In this embodiment, the positions of the work stations 3*a*, 3*b*, 4 cannot be changed in the production direction P.

A process step of the first sealing station 3*a* consists of sealing the troughs 14 of a format F1, which is done by applying suitable pressure and heat to the packaging film 8 and the cover film 10. A process step of the second sealing station 3*b* consists, analogously, of producing a sealing of the troughs 14 of the second format F2, while a process step of the cutting station or cross cutting unit 4 consists of cutting through the packaging film 8 using a suitable separating tool, e.g. a blade.

Figure 2C:
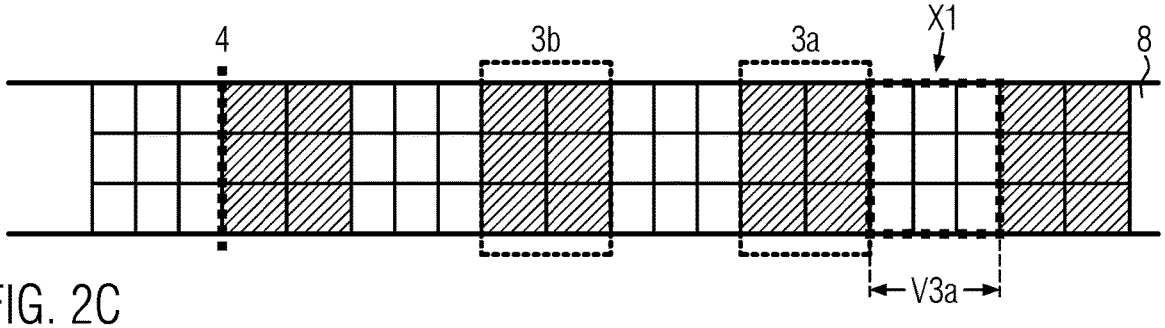
FIG. 2C is a schematic top view of a state of operation of the thermoform packaging machine according to FIG. 1.
Figure 2D:
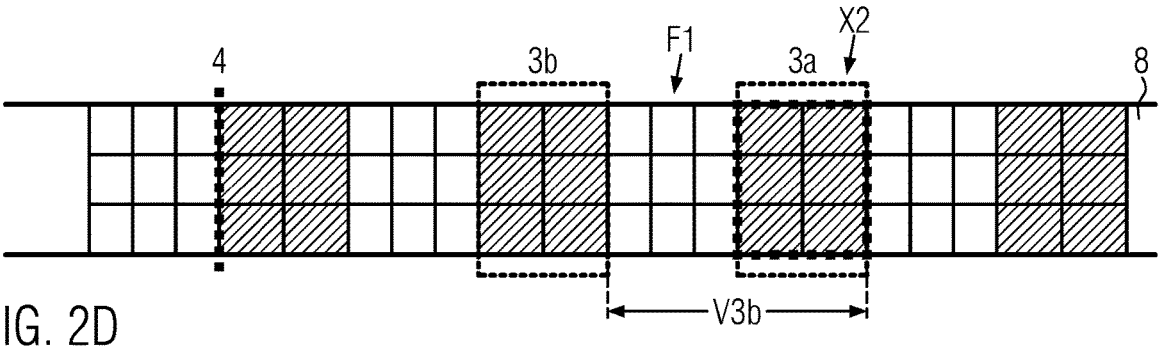
FIG. 2D is a schematic top view of a state of operation of the thermoform packaging machine according to FIG. 1.
Figure 2E:
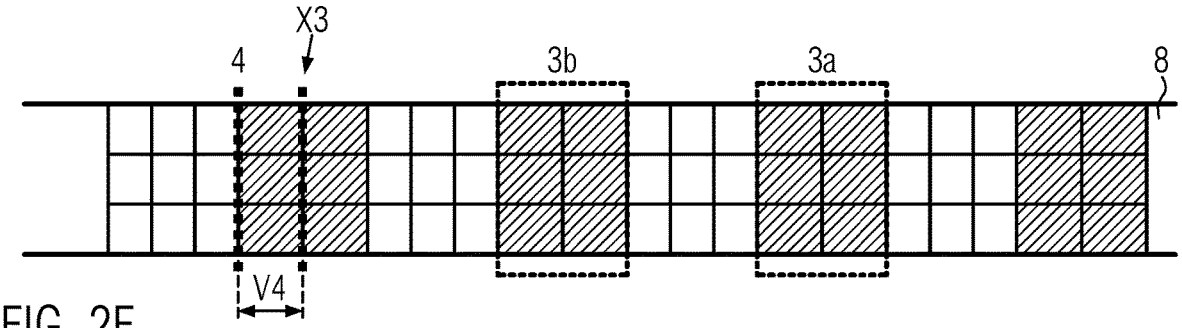
FIG. 2E is a schematic top view of a state of operation of the thermoform packaging machine according to FIG. 1.

FIGS. 2C to 2E show which feed length is required for the work stations 3*a*, 3*b*, 4 in the respective situation of the operating state of the thermoform packaging machine 1 shown in FIG. 2B. The phrase "required feed length" means here the distance by which the packaging film 8 has to be conveyed so that the respective work station 3*a*, 3*b*, 4 will be able to execute its next process step.

In FIG. 2C, X1 designates the first format F1 which is the closest format upstream of the first sealing station 3*a* and, consequently, the next first format F1 that is to be sealed in the sealing station 3*a*. In order to allow sealing, the format X1 may be conveyed completely into the first sealing station 3*a*. The required feed length V3*a*, by which the format X1 must be conveyed for this purpose, is here 300 mm, i.e. it corresponds precisely to an unwinding length AZL of the first format F1.

FIG. 2D shows that, at this moment in time, a first format F1 is present directly upstream of the second sealing station 3*b*, which cannot be sealed in the second sealing station 3*b* (and which may already have been sealed by the first sealing station 3*a* anyhow). X2 designates the second format F2, which is the closest format upstream of the second sealing station 3*b*. In order to allow this format X2 to be sealed in the second sealing station 3*b*, it will be necessary to advance the packaging film 8 by a distance of 600 mm. This means that, in this situation, the required feed length V3*b* of the second sealing station 3*b* is 600 mm and is thus equal to twice the unwinding length.

In the same operating state, FIG. 2E shows the required feed length V4 of the cutting station 4. This required feed length corresponds to only half an unwinding length, i.e. 150 mm, until the next transverse cut can be executed at a location X3 after the next row R.

The controller 18 of the thermoform packaging machine 1 comprises, as shown in FIG. 1, a determining section 18*a*, which is configured to determine, for two or more work stations 3*a*, 3*b*, 4, a required feed length V3*a*, V3*b*, V4 for the respective work station 3*a*, 3*b*, 4. To this end, the determining section 18*a* may e.g. be configured to receive and store the required feed length V3*a*, V3*b*, V4 of the respective work stations 3*a*, 3*b*, 4. Alternatively, the determining section 18*a* may, for example, be configured in the form of a path controller and may be adapted to have, at any time, knowledge of the positions of the respective formats F1, F2 and of the dividing lines between two neighboring rows R in the production direction P of the thermoform packaging machine. This enables the determining section 18*a* to calculate by itself the required feed length V3*a*, V3*b*, V4 of the respective work stations 3*a*, 3*b*, 4. In addition, the determining section 18*a* may be configured to detect whether it already has knowledge of the current required feed length of each of the work stations 3*a*, 3*b*, 4 to be taken into account.

The controller 18 further comprises an evaluation section 18*b*, which is configured to ascertain a feed length specification VV from the required feed lengths V3*a*, V3*b*, V4 determined. This feed length specification VV will finally be transmitted by the controller 18 as a control command to the feeding device 11, in the embodiment shown concretely to the servomotor 12*a*, so that the latter will convey the clamp chain 12 and thus the packaging film 8 grasped by the clamp chain by a feed length V, which corresponds to the feed length specification VV, in the production direction P.

It follows that in the situation shown in FIGS. 2B to 2E, the determining section 18*a* determines the respective required feed lengths V3*a*, V3*b*, V4 of the work stations 3*a*, 3*b*, 4. In this embodiment, the evaluation section 18*b* is configured to ascertain the smallest one of the determined required feed lengths V3*a*, V3*b*, V4 as feed length specification VV. In the situation described, V3*a*=300 mm, V3*b*=600 mm, V4=150 mm. The smallest of these values is V4=150 mm, so that the feed length specification VV=150 mm.

Figure 2F:
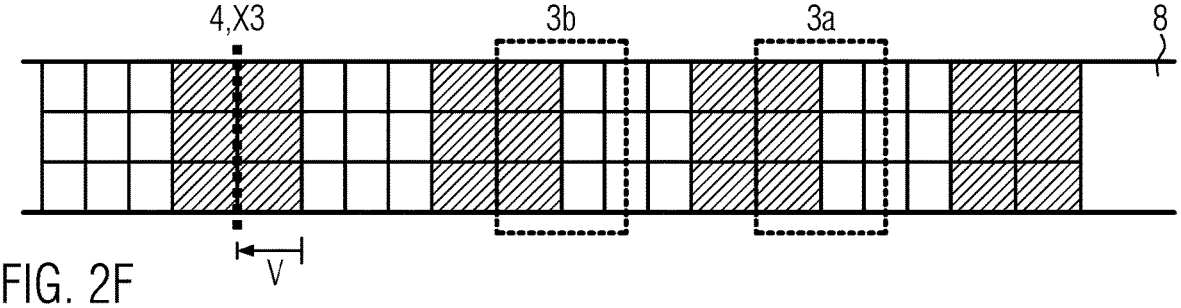
FIG. 2F is a schematic top view of a state of operation of the thermoform packaging machine according to FIG. 1.

The feed length specification VV is transmitted as a command to the feeding device 11, which will then cause the packaging film 8 to be conveyed by a corresponding feed length V=150 mm, as shown in FIG. 2F. In the situation shown in FIG. 2F, the cutting station 4 can now execute its next process step, i.e. it can cut through the packaging film 8 at location X3. The two sealing stations 3*a*, 3*b*, however, remain inactive, i.e. they cannot yet execute their respective process step.

Figure 3A:
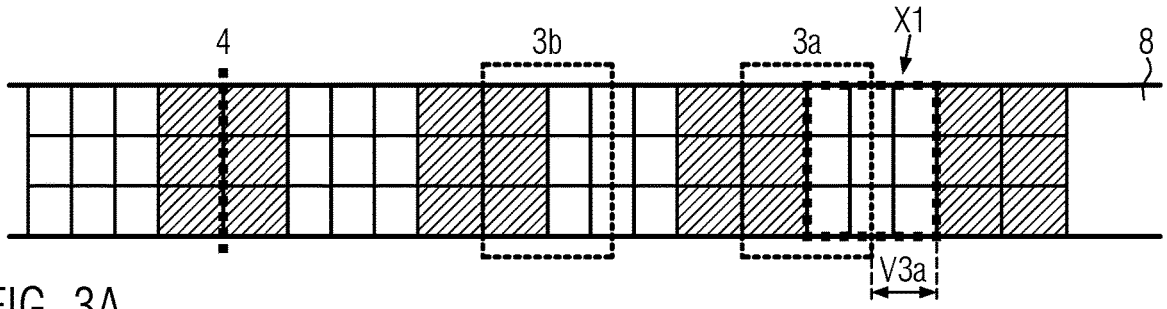
FIG. 3A is a schematic top view of a state of operation of the thermoform packaging machine according to FIG. 1.

FIG. 3A shows, starting from the situation accomplished in FIG. 2F, the required feed length V3*a* for the first sealing station 3*a*. The format X1 still has to be advanced by a length of V3*a*=150 mm, so that the format X1 will lie completely within the first sealing station 3*a* and can be sealed there. This residual required feed length V3*a* already results as a difference between the required feed length V3*a* according to FIG. 2C and the feed V of the packaging film 8, which has taken place in the meantime, according to FIG. 2F.

Figure 3B:
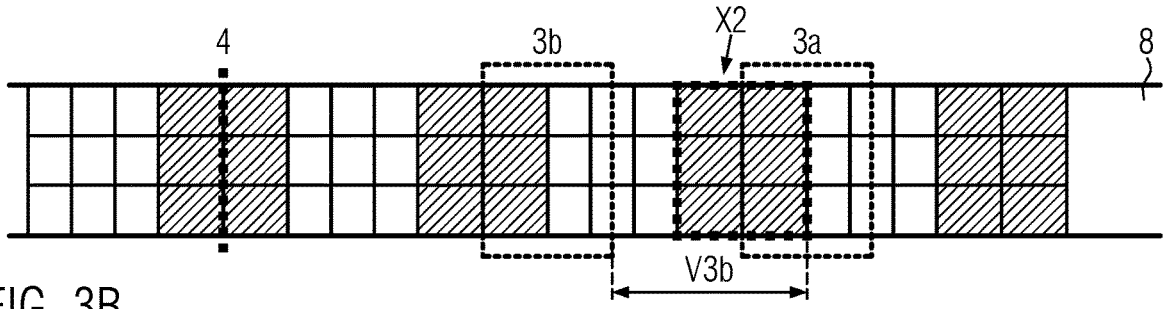
FIG. 3B is a schematic top view of a state of operation of the thermoform packaging machine according to FIG. 1.

FIG. 3B shows, analogously, the current required feed length V3*b* of the second sealing station 3*b*. Here, the format X2 has to be advanced by a length of V3*b*=450 mm, so that it can be sealed in the second sealing station 3*b*.

Figure 3C:
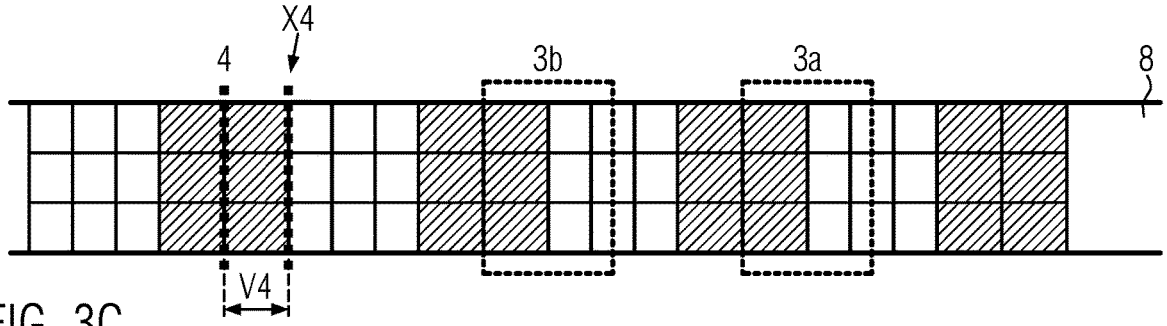
FIG. 3C is a schematic top view of a state of operation of the thermoform packaging machine according to FIG. 1.

Finally, FIG. 3C shows the new required feed length V4 for the cross cutting station 4. In order to allow a transverse cut to be executed at a location X4 after the next row R of packaging troughs 14 located upstream of the cutting station 4, the required feed length V4 for the cutting station 4 is a length of 150 mm.

After the respective required feed lengths V3*a*, V3*b*, V4 have been determined by the determining section 18*a*, the evaluation section 18*b* ascertains the smallest required feed length, here V3*a*=V4=150 mm, and sets it as feed length specification VV=150 mm.

Figure 3D:
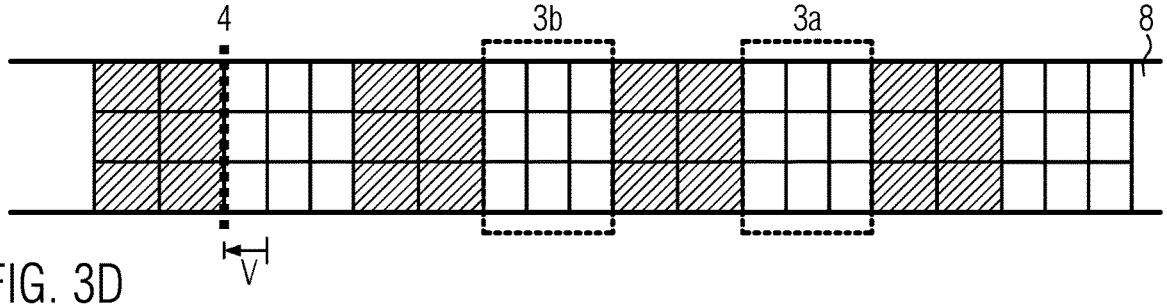
FIG. 3D is a schematic top view of a state of operation of the thermoform packaging machine according to FIG. 1.

FIG. 3D shows the situation after the packaging film 8 has been advanced, starting from FIG. 3C, by the feed length V=150 mm corresponding to the feed length specification VV. In the situation according to FIG. 3D, the next process step of the first sealing station 3*a*, i.e. sealing of the format X1, as well as the next process step of the cutting station 4, i.e. cutting through the packaging film 8 at location X4, can now take place.

Figure 4A:
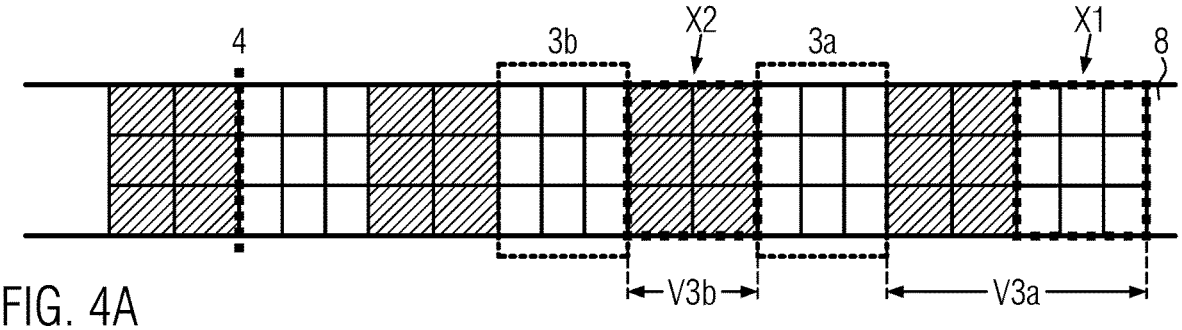
FIG. 4A is a schematic top view of a state of operation of the thermoform packaging machine according to FIG. 1.

FIG. 4A shows, starting from FIG. 3D, the required feed length V3*a* for the first sealing station 3*a*. The next first format F1 upstream of the first sealing station 3*a* is positioned at location X1 and may be conveyed by a feed length V3*a*=600 mm, so that it can be sealed in the first sealing station 3*a*. The next second format F2 upstream of the second sealing station 3*b* is positioned at location X2 and may be conveyed by a length V3*b*=300 mm, so that it can be sealed in the second sealing station 3*b*.

Figure 4B:
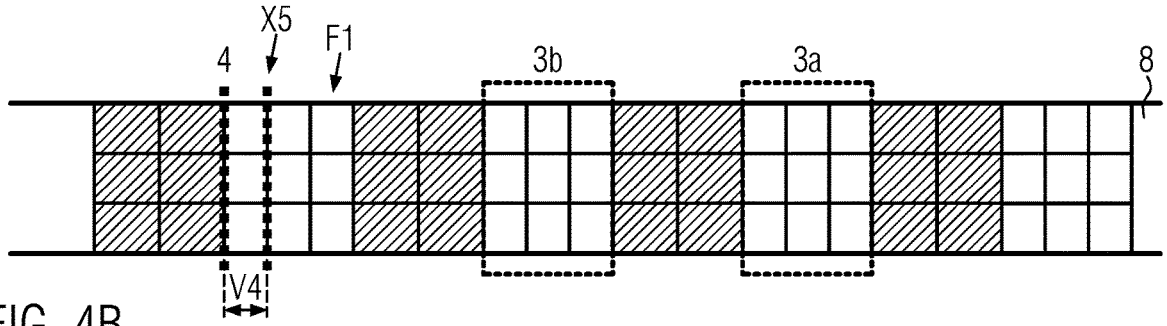
FIG. 4B is a schematic top view of a state of operation of the thermoform packaging machine according to FIG. 1.

FIG. 4B shows in this situation the required feed length V4 of the cross cutting station 4. A first format F1 having a row length RL=100 mm (cf. FIG. 2A) is now located directly upstream of the cutting station 4. In order to enable the cutting station 4 to place the next cut at location X5, i.e. after the next row R, the cutting station 4 has a required feed length of V4=100 mm.

Among the determined required feed lengths V3*a*=600 mm, V3*b*=300 mm, V4=100 mm, the smallest value is the required feed length V4=100 m for the cutting station 4. The evaluation section 18*b* ascertains this smallest required feed length V4 and transmits it as feed length specification VV to the feeding device 11.

Figure 4C:
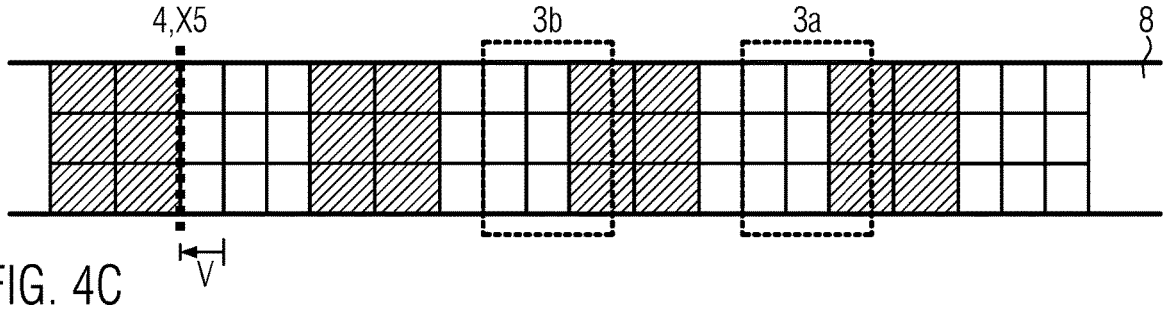
FIG. 4C is a schematic top view of a state of operation of the thermoform packaging machine according to FIG. 1.

FIG. 4C shows the situation after the feeding device 11 controlled in this way has advanced the packaging film 8 by a feed length V=100 mm. The cutting station 4 can now place the cut at location X5.

Figure 5A:
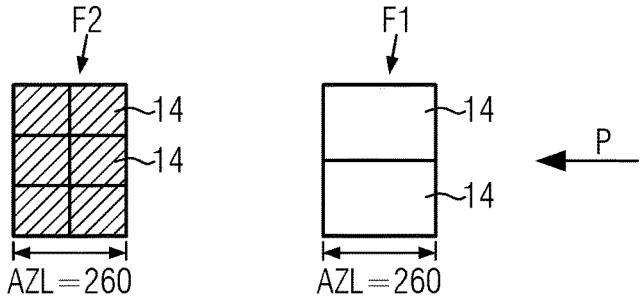
FIG. 5A is a schematic top view of another embodiment of two different formats that can be produced using the thermoform packaging machine of FIG. 1 in accordance with the present disclosure.

FIG. 5A shows a second embodiment of two formats F1, F2. The first format F1 comprises here two tracks and one row, with an unwinding length AZL of 260 mm. The second format F2, however, comprises three tracks and two rows, the unwinding length AZL being again 260 mm.

Figure 5B:
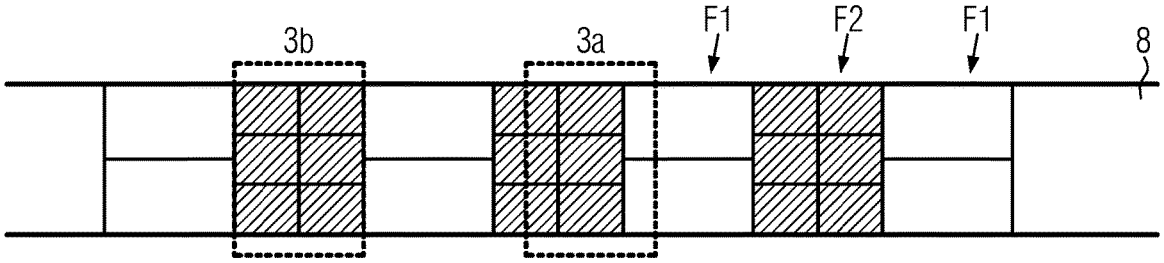
FIG. 5B is a schematic top view of a state of operation of the thermoform packaging machine according to FIG. 5A.

FIG. 5B shows a specific operating state of the thermoform packaging machine 1. First and second formats F1, F2 of troughs 14 have been produced alternately one after the other on the packaging film 8. The first sealing station 3*a* is configured to seal the first format F1, while the second sealing station 3*b* is configured to seal the troughs 14 of a second format F2.

Figure 5C:
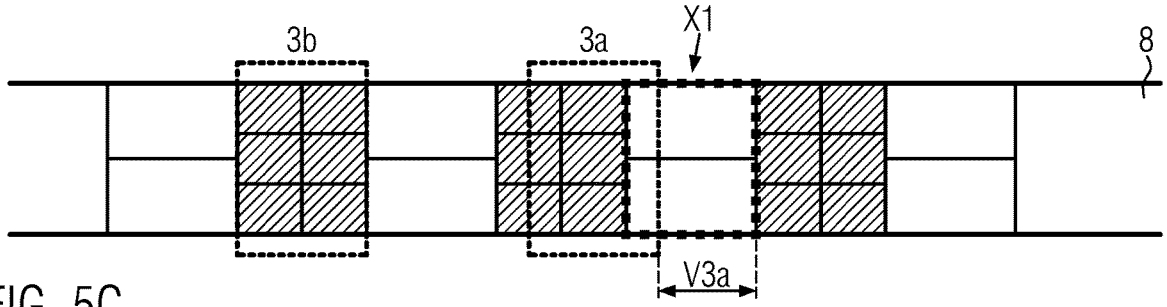
FIG. 5C is a schematic top view of a state of operation of the thermoform packaging machine according to FIG. 5A.

FIG. 5C shows the required feed length V3*a* for the first sealing station 3*a*. The next first format F1 upstream of the first sealing station 3*a* is positioned at location X1. The required feed length V3*a* for the first sealing station 3*a* is therefore 195 mm.

Figure 5D:
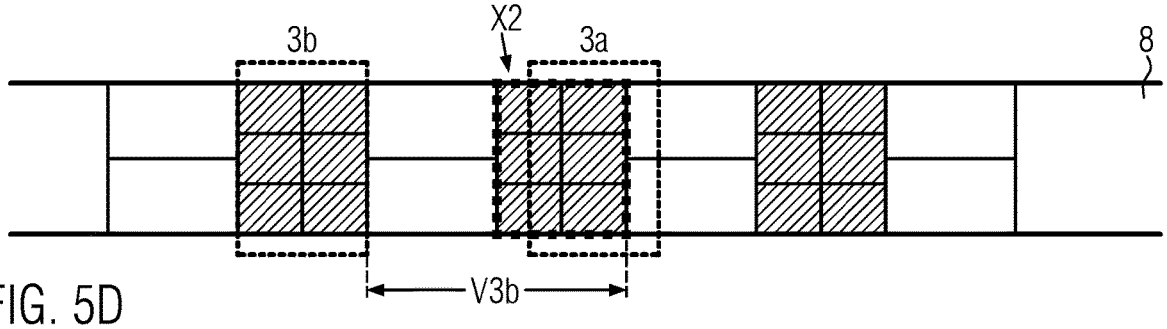
FIG. 5D is a schematic top view of a state of operation of the thermoform packaging machine according to FIG. 1.

FIG. 5D shows, at the same moment in time, the required feed length V3*b* of the second sealing station 3*b*. Upstream of the second sealing station 3*b*, the closest second format F2 is at location X2. The required feed length V3*b* of the second sealing station 3*b* is therefore V3*b*=520 mm. If only the two sealing stations 3*a*, 3*b* are to be taken into account, the evaluation section 18*b* will ascertain the value V3*a*=195 mm as the smallest required feed length and transmit the latter as feed length specification to the feeding device 11.

Figure 5E:
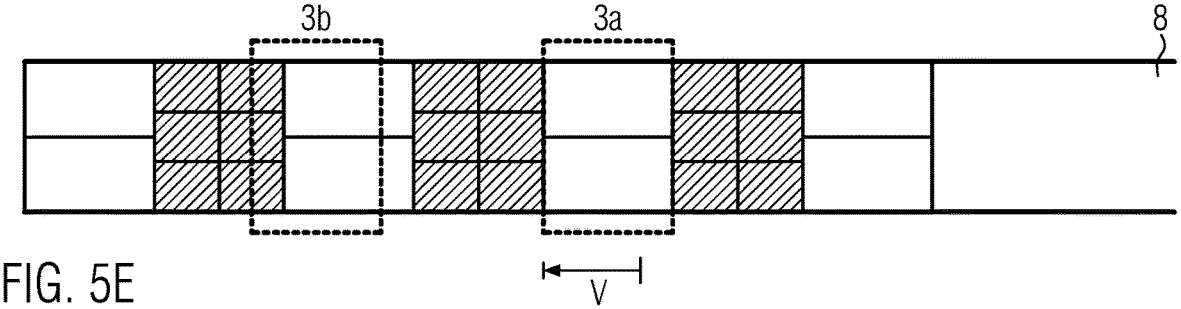
FIG. 5E is a schematic top view of a state of operation of the thermoform packaging machine according to FIG. 5A.

FIG. 5E shows the situation after the feeding device 11 has advanced the packaging film 8 according to the feed length specification VV by the feed length V=195 mm. The first sealing station 3*a* will now be able to execute its next process step and seal the format X1 with the cover film 10.

Figure 6A:
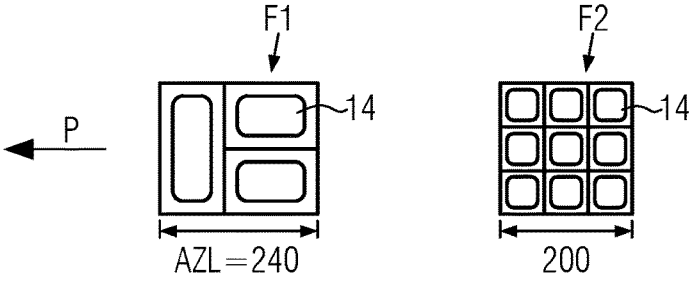
FIG. 6A is a schematic top view of another embodiment of two different formats that can be produced using the thermoform packaging machine in accordance with the present disclosure.

FIG. 6A shows a third embodiment of two different formats F1, F2, which can be produced in the packaging film 8 with one forming station 2 or with two successive forming stations 2. The first format F1 comprises here three troughs 14 of different sizes and has a total "unwinding length" AZL=240 mm in the production direction P. The second format F2, however, consists of a 3×3 array of approximately identically sized packaging troughs 14 (i.e. three tracks S and three rows R) and has a total unwinding length AZL of 200 mm.

Figure 6B:
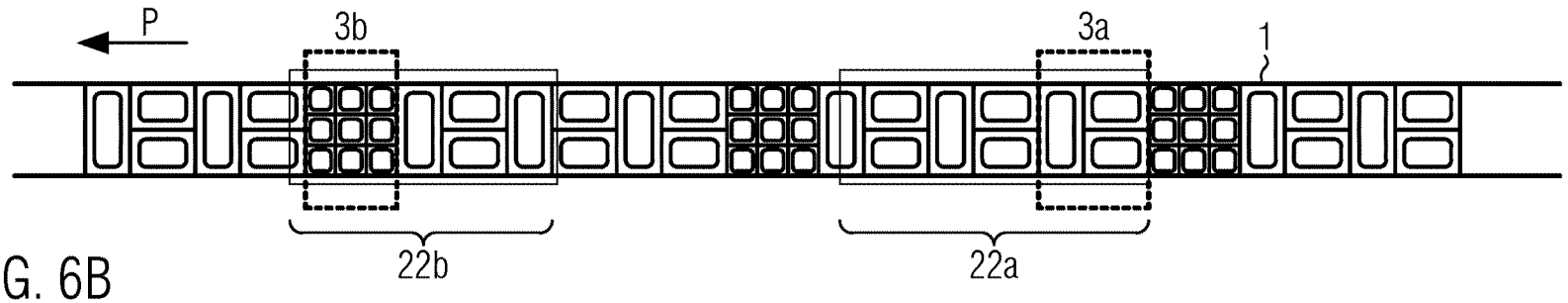
FIG. 6B is a schematic top view of a state of operation of the thermoform packaging machine of FIG. 6A.

FIG. 6B shows, in a top view, a specific operating state of the thermoform packaging machine 1, which comprises a first sealing station 3*a* for sealing first formats F1 and, downstream thereof, a second sealing station 3*b* for sealing second formats F2 of troughs 14. In this embodiment, the positions of each of the two sealing stations 3*a*, 3*b* can be changed in the production direction P. Concretely, the position of the first sealing station 3*a* can be displaced using an associated linear drive 21 over an area of displacement 22*a*, which is shown in FIG. 6B and which has a total length of e.g. 675 mm. Analogously, the position of the second sealing station 3*b* can be adjusted in the production direction P (i.e. parallel to the production direction P) using an associated linear drive 21 over an area of displacement 22*b* having a total length of e.g. 585 mm.

Figure 6C:
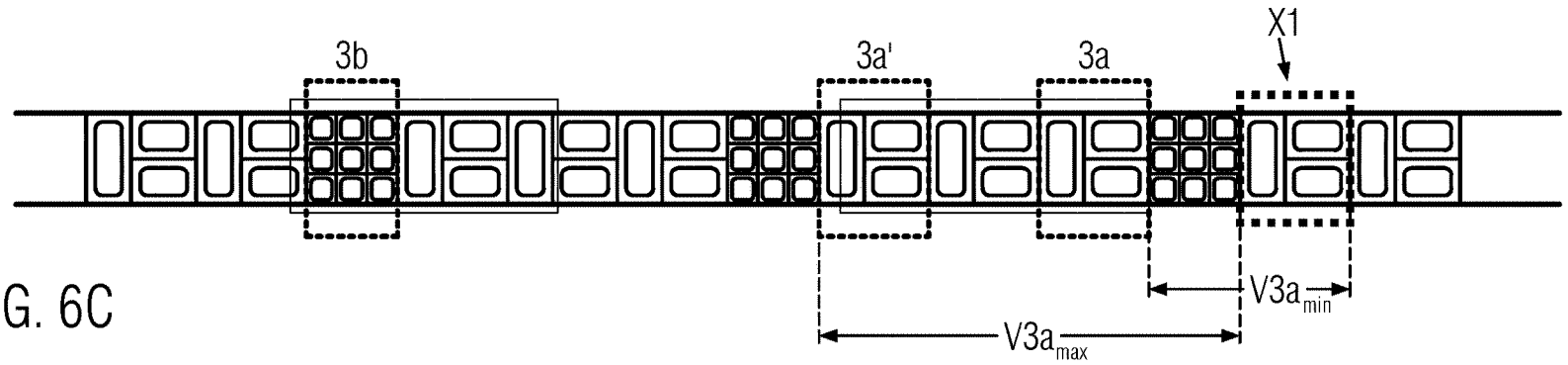
FIG. 6C is a schematic top view of a state of operation of the thermoform packaging machine of FIG. 6A.

FIG. 6C visualizes the required feed length V3*a* of the first sealing station 3*a*. For moving the first format F1, which is positioned at location X1 and thus closest to the first sealing station 3*a* in an upstream direction, to the position which the first sealing station 3*a* occupies at the moment in question, a minimum feed V3*a* min=440 mm would be necessary. However, the first sealing station 3*a* can also be moved to the furthest downstream end of its area of displacement 22*a*, as indicated by reference numeral 3*a*'. For moving the next format X1 to this location, a feed of V3*a* max=875 mm would be necessary. It follows that the required feed length V3*a* for the first sealing station 3*a* is here not a singular value, but a feed length specification range VBa (cf. FIG. 6E), which ranges from the minimum value V3*a* min to the maximum required feed length V3*a* max.

Figure 6D:
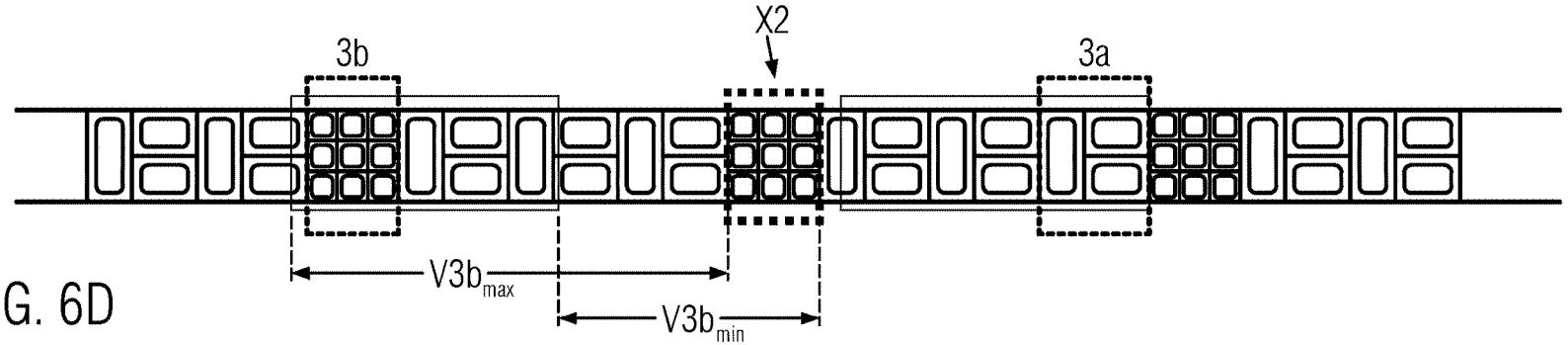
FIG. 6D is a schematic top view of a state of operation of the thermoform packaging machine of FIG. 6A.
Figure 6E:
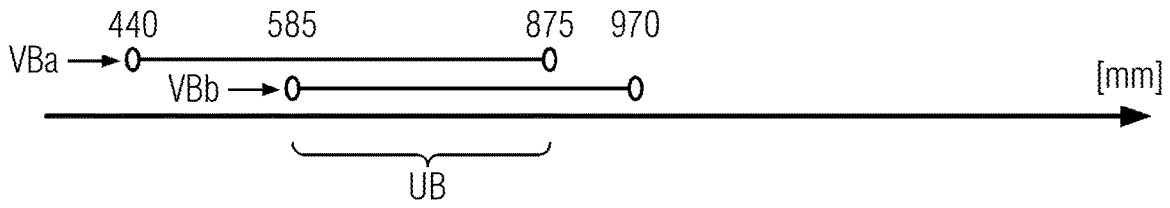
FIG. 6E is a schematic representation of the overlapping range feed length specification range of a thermoform packaging machine in accordance with the present disclosure.

Analogously, FIG. 6D visualizes the simultaneously existing required feed length V3*b* of the second sealing station 3*b*. In order to enable the latter to seal the second format F2, which is positioned at location X2 and closest to the second sealing station 3*b* in an upstream direction, the second format F2 (and consequently the packaging film 8 as a whole) must be advanced by at least V3*b* min=585 mm. With due regard to the area of displacement 22*b* of the second sealing station 3*b*, the film feed length can be V3*b* max=970 mm at the most, if the second sealing station 3*b* is moved to its furthest downstream position. The feed length specification range VBb of the second sealing station 3*b* thus ranges from 585 mm to 954 mm, as shown in FIG. 6E.

After the determining section 18*a* of the controller 18 has determined the feed length specification ranges VBa, VBb as required feed lengths, the evaluation section 18*b* ascertains therefrom an overlapping range UB, in which the feed length specification ranges VBa, VBb of the work stations 3*a*, 3*b* involved overlap. From this overlapping range UB, the evaluation section 18*b* selects a specific value as feed length specification VV. This value may, for example, be a value in the middle third of the overlapping range UB, preferably even the mean value of the overlapping range UB. Alternatively, it would be imaginable that the evaluation section 18*b* selects the lowest value of the overlapping range UB, so as to keep the feed length V as small as possible. The selected feed length specification VV is transmitted as a control command to the feeding device 11, so that the latter will advance the packaging film 8 by a corresponding feed length V.

A further variant of the control method could be optimized insofar as the feed length specification VV is selected from the overlapping range UB such that the work stations involved will remain in a central region of their respective areas of displacement 22*a*, 22*b* as far as possible.

According to still another variant, the evaluation section 18*b* may be configured to select the feed length specification VV from the overlapping range UB under the aspect of minimizing the total time that will elapse until the next process step of an arbitrary work station takes place, since this will improve the performance of the thermoform packaging machine 1 as a whole. To this end, it would be possible to displace one or a plurality of the involved work stations in an upstream direction, i.e. opposite to the direction of film feed, so as to obtain in total as quickly as possible a new situation, which allows a process step of an arbitrary work station.

Figure 7:
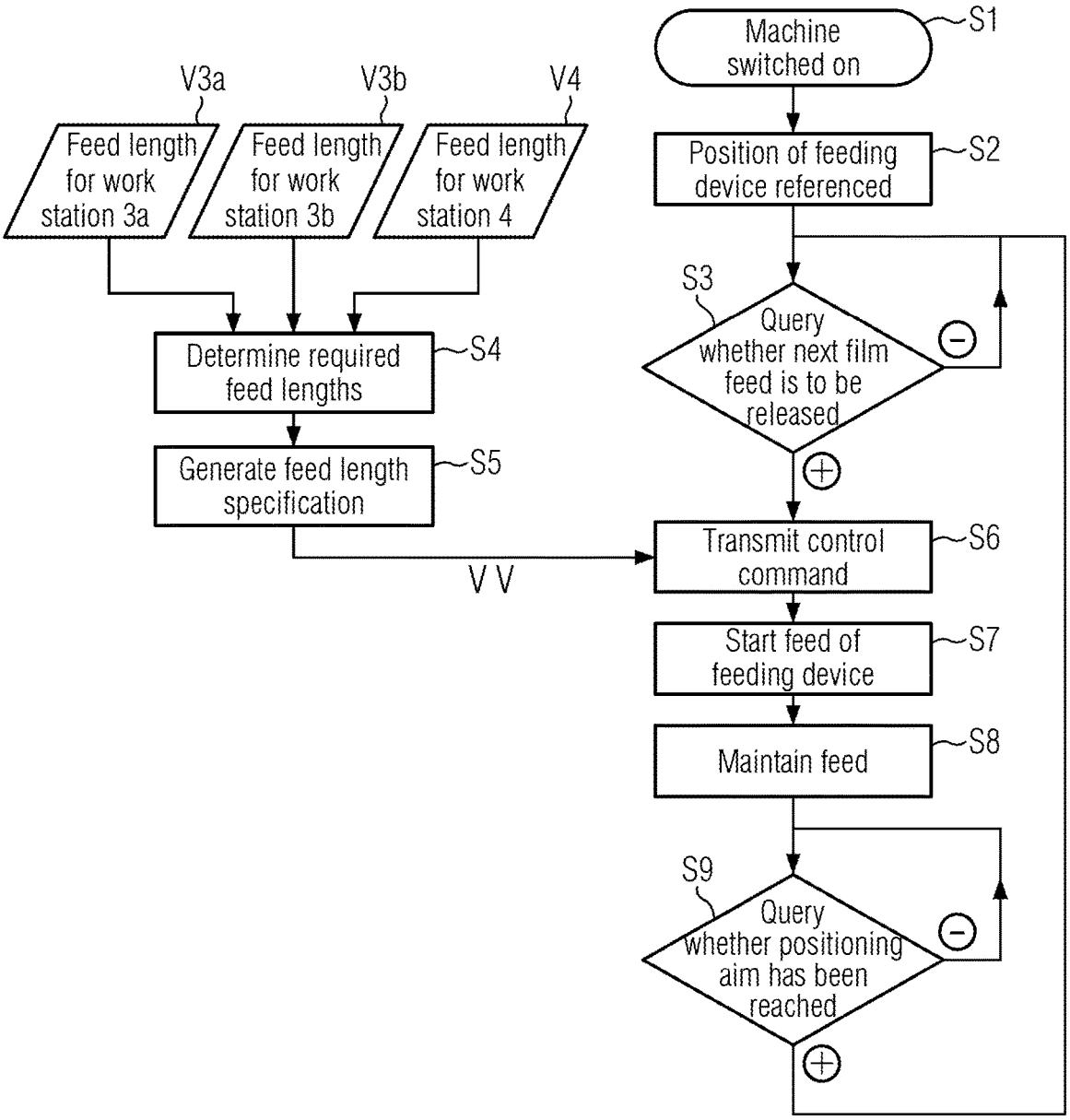
FIG. 7 shows a schematic view of one embodiment of the operating sequence of the thermoform packaging machine in accordance with the present disclosure.

FIG. 7 shows in a flow chart a few steps of the method according to the present invention and of the operating sequence of the thermoform packaging machine 1, respectively.

With S1, the machine is switched on. With S2, the current position of the servomotor 12*a* of the feeding device 11 is referenced.

With S3, a query is made as to whether the next film feed is to be released. This includes a query as to whether each work station 2, 3*a*, 3*b*, 4, 5 has finished a process step intended for the respective work station.

At the same time, the determining section 18*a* of the controller 18 determines in step S4 the required feed lengths V3*a*, V3*b*, V4 . . . of all the work stations 3*a*, 3*b*, 4 to be taken into consideration. It transmits the values determined to the evaluation section 18*b* of the controller 18, which generates therefrom a feed length specification VV in step S5.

As soon as the next feed of the packaging film 8 has been released in step S3, a control command correlating with the feed length specification VV is transmitted to the drive 12*a* of the feeding device 11 in step S6.

In step S7, the servomotor 12*a* starts the feed of the feeding device 11 and maintains it in step S8 until a query in step S9 shows that the positioning aim has been reached, i.e. feeding by the desired feed length V has taken place. The process then goes back to step S3, in which the next feed release will be given after the respective process steps of the work stations 3*a*, 3*b* or 4 have been carried out.

Hence, the gist of the present invention is to be seen in that the feed length is no longer kept constant from one work cycle to the next, but, on the contrary, may vary from each process step to the next, in particular with due regard to the individual required feed lengths of a plurality of work stations.

On the basis of the embodiments shown, the method and the thermoform packaging machine 1 may be modified in many respects. Of course, the values given are only examples, which have only been used for illustrative purposes. It is well imaginable to process also more than two different formats F1, F2 on a thermoform packaging machine 1 according to the present invention. To this end, a corresponding number of sealing stations 3*a*, 3*b* is preferably provided. Also the configuration of the formats F1, F2 may, of course, significantly deviate from the examples shown. In addition, it would be imaginable to take into account the required feed length for a top film printing station used as a work station for printing on the top film in the method according to the present invention.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method of operating a thermoform packaging machine comprising a controller and, as work stations, a forming station for thermoforming troughs in a packaging film, at least one sealing station for sealing the troughs with a cover film, and a cutting station, the thermoform packaging machine comprising in addition a feeding device for causing a feed of the packaging film, wherein the method comprises:

determining, by the controller, a required feed length for each of two or more work stations, prior to a process step, the required feed length indicating a distance by which the packaging film will have to be conveyed for the next process step of the respective work station;

ascertaining a feed length specification from the determined required feed lengths; and conveying the packaging film by a feed length corresponding to the feed length specification by controlling the feeding device;

wherein the thermoform packaging machine is cyclically operated, wherein, for each work cycle of the thermoform packaging machine, a required feed length for each of the two or more work stations is determined and a feed length specification is ascertained therefrom, and wherein the feed length specification corresponds to a smallest required feed length of the determined required feed lengths.

2. The method according to claim 1, wherein the thermoform packaging machine has a production direction and a position of at least one of the work stations is displaced in the production direction.

3. The method according to claim 2, wherein positions of a plurality of the work stations are displaceable in the production direction over a predetermined area of displacement, and, taking into account the area of displacement, a feed length specification range is determined for each of these work stations.

4. The method according to claim 3, wherein the feed length specification is chosen from an overlapping range in which the feed length specification ranges of the work stations, which have positions that are displaceable in the production direction, overlap.

5. A thermoform packaging machine comprising:

multiple work stations including at least one forming station for thermoforming troughs in a packaging film, at least one sealing station for sealing the troughs with a cover film, and at least one cutting station, the thermoform packaging machine comprising in addition a feeding device for causing a feed of the packaging film as well as a controller, wherein the feeding device is configured for generating a feed length which is variable per process step of the thermoform packaging machine, the controller comprises a determining section, which is configured to determine, for each of two or more of the work stations, a required feed length of the respective work station, the required feed length indicating a distance by which the packaging film will have to be conveyed for the next process step of the respective work station, the controller comprises an evaluation section, which is configured to ascertain a feed length specification from the determined required feed lengths of the two or more work stations, the evaluation section is configured to ascertain the feed length specification as a smallest required feed length of the determined required feed lengths, and the controller is configured to control the feeding device to move the packaging film by a feed length corresponding to the feed length specification, and wherein the thermoform packaging machine is configured to be operated cyclically, and the controller is configured to determine required feed lengths of the two or more work stations in each individual work cycle and ascertain a feed length specification therefrom.

6. The thermoform packaging machine according to claim 5, wherein the feeding device is configured for generating a stepwise variable or a continuously variable feed length.

7. The thermoform packaging machine according to claim 5, wherein the feeding device comprises a clamp chain with a controllable servomotor.

8. The thermoform packaging machine according to claim 5, wherein the thermoform packaging machine has a production direction and a position of at least one of the work stations is displaceable in the production direction.

9. The thermoform packaging machine according to claim 5, wherein the thermoform packaging machine has a production direction, positions of a plurality of the work stations are displaceable in the production direction over a predetermined area of displacement, and a feed length specification range is determinable for each of these work stations, taking into account their respective area of displacement.

10. The thermoform packaging machine according to claim 9, wherein the evaluation section is configured for ascertaining an overlapping range, in which the feed length specification ranges of the work stations, which have positions that are displaceable in the production direction, overlap, and for selecting the feed length specification from the overlapping range.

11. A method of operating a thermoform packaging machine comprising:

providing a thermoform packaging machine comprising a controller, a feeding device, and multiple workstations including a forming station for thermoforming troughs in a packaging film, at least one sealing station for sealing the troughs with a cover film, and a cutting station;

determining a required feed length for each of two or more of the work stations using the controller prior to a process step, wherein, for each of the two or more work stations, the required feed length is a distance by which the packaging film will have to be conveyed for the next process step of the respective work station;

ascertaining a feed length specification using the determined required feed lengths; and conveying the packaging film by a feed length corresponding to the feed length specification using the feeding device;

wherein each of the required feed lengths is used to determine a feed length specification range for the respective work station, and wherein the feed length specification is determined based on an overlapping range in which the feed length specification ranges of the two or more work stations overlap.

12. The method according to claim 11, wherein the thermoform packaging machine is cyclically operated, and wherein, for each work cycle of the thermoform packaging machine, a required feed length for each of the two or more work stations is determined and a feed length specification is ascertained therefrom.

13. The method according to claim 11, wherein the feed length specification corresponds to a smallest required feed length of the required feed lengths determined for the two or more work stations.

14. The method according to claim 11, further comprising the step of displacing at least one of the work stations in a production direction of the thermoform packaging machine.

15. The method according to claim 11, further comprising the step of determining a feed length specification range for each of a plurality of the work stations, wherein positions of the plurality of the work stations are displaceable in the production direction over a predetermined area of displacement, and the determining a feed length specification range for each of the plurality of the work stations takes into account the predetermined area of displacement.

16. The method according to claim 15, wherein the feed length specification is chosen from an overlapping range in which the feed length specification ranges of the plurality of the work stations overlap.

17. The method according to claim 11 wherein the feed length specification is determined as one of the required feed lengths.

18. The method according to claim 11 wherein the method is carried out so that troughs having different formats are formed in the packaging film in a production direction of the thermoform packaging machine.

* * * * *